United States Patent [19]

Glover

[11] 4,054,221

[45] Oct. 18, 1977

[54] BOTTLE CLOSURE

[76] Inventor: Ellis C. Glover, 225 Kirkwood Road, Gibbsboro, N.J. 08026

[21] Appl. No.: 698,525

[22] Filed: June 22, 1976

[51] Int. Cl.[2] ..... B65D 55/16

[52] U.S. Cl. ..... 215/235; 215/306

[58] Field of Search ..... 215/235, 237, 306, 101; 220/339, 375

[56] References Cited

U.S. PATENT DOCUMENTS

| | | | |
|---|---|---|---|
| 511,538 | 12/1893 | Mockler | 215/235 |
| 578,920 | 3/1897 | Gulden | 215/235 |
| 1,104,706 | 7/1914 | Ramsey | 215/101 X |
| 1,650,517 | 11/1927 | Hughes | 215/306 X |
| 2,763,392 | 9/1956 | Makela | 215/101 X |
| 2,789,717 | 4/1957 | Demke | 215/235 |
| 3,257,022 | 6/1966 | Robinson | 215/235 |

*Primary Examiner*—Donald F. Norton

[57] ABSTRACT

This invention is concerned with a closure for a bottle or jar wherein the neck of the bottle or jar is provided with an annular bead spacer from the mouth, and the closure includes a clip removably embraceable about the neck for retention by the bead, a strap extending from the clip along the neck, and a cap on the strap remote from the clip for closing engagement over the mouth.

8 Claims, 4 Drawing Figures

FIG. 1
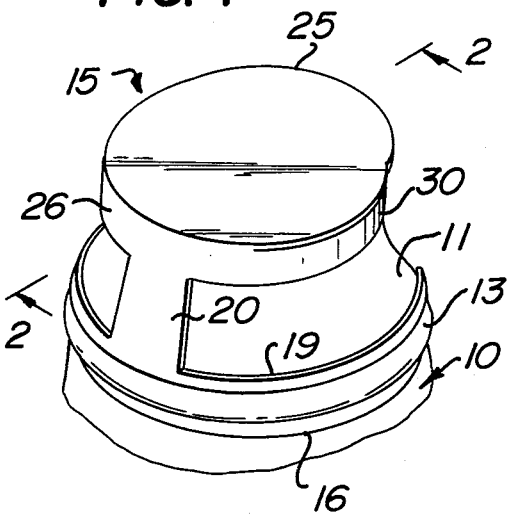
FIG. 2
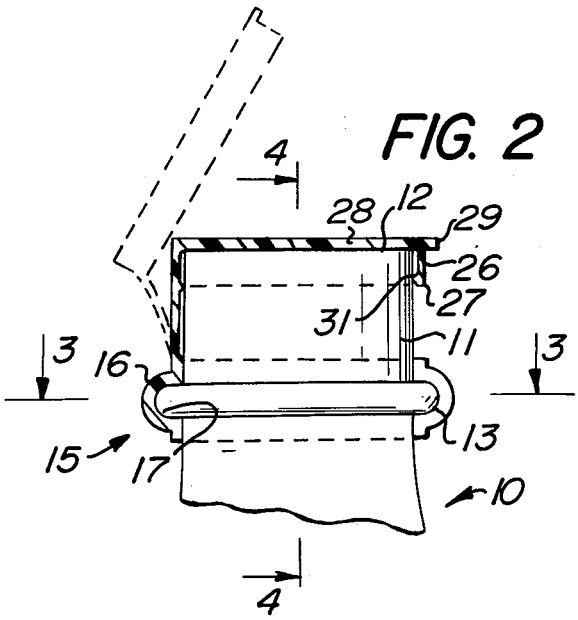
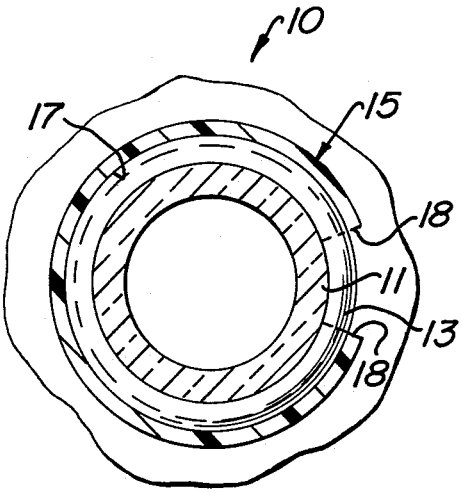
FIG. 3
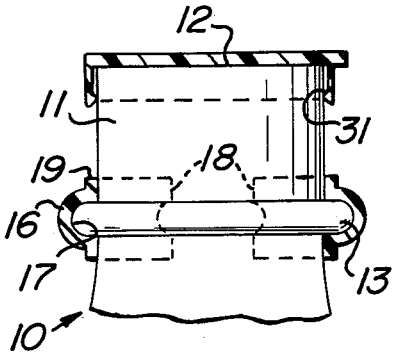
FIG. 4

BOTTLE CLOSURE

BACKGROUND OF THE INVENTION

There have, in the past, been proposed replacement closures for bottles and jars, such as catsup, syrup, and the like, but such replacement closures have been relatively complex, highly specialized for use with only a single type container, incapable of quick and easy use including removal and replacement, and for these and other reasons have not found wide consumer acceptance.

SUMMARY OF THE INVENTION

Accordingly, it is an important object of the present invention to provide a replacement closure for bottles, jars and the like, which overcomes the above-mentioned difficulties, is extremely simple in construction, economical to manufacture and sell, and extremely quick and easy to mount on and remove from a container, as well as to open and close with respect to the container.

It is still a further object of the present invention to provide a bottle closure having the advantageous characteristics mentioned in the preceding paragraph which is staunch and durable in construction, capable of economical mass producion, and which otherwise fully accomplishes its intended objects.

Other objects of the present invention will become apparent upon reading the following specification and referring to the accompanying drawings, which form a material part of this disclosure.

The invention accordingly consists in the features of construction, combinations of elements and arrangements of parts, which will be exemplified in the construction hereinafter described, and of which the scope will be indicated by the appended claims.

BRIEF DESCRIPTION OF THE DRAWINGS

FIG. 1 is a top perspective view showing a bottle closure of the present invention in enclosed relation on a bottle.

FIG. 2 is a sectional elevational view taken generally along the line 2—2 of FIG. 1, showing an open position in phantom.

FIG. 3 is a horizontal sectional view taken generally along the line 3—3 of FIG. 2.

FIG. 4 is a sectional elevational view taken generally along the line 4—4 of FIG. 2.

DESCRIPTION OF THE PREFERRED EMBODIMENT

Referring now more particularly to the drawings, and specifically to FIGS. 1 and 2 thereof, a bottle is there generally designated 10, and may include a bottle neck 11 terminating upwardly in an open end or mouth 12. The bottle 10 is provided circumferentially about its neck 11, at a location spaced inwardly or downwardly from its mouth 12 with an annular shoulder, rib or bead 13. As thus far described, the container 10 may be a generally conventional bottle, say a catsup bottle, or the like, and may have screw threads, or other conventional features, if desired.

Applied to and carried by the bottle or container 10 is a closure, generally designated 15, constructed in accordance with the teachings of the present invention. The closure 15 may be integrally molded of a single piece of plastic, if desired, or fabricated of separate pieces and suitably assembled and fastened, if preferred. In mass producion it is probable that the closure 15 will be integrally molded as a single piece of plastic, and has been so illustrated herein.

The instant bottle closure includes a clip or split ring generally designated 16, which is of generally C-shaped configuration in plan view, see FIG. 3, and of a stiff resilient characteristic for embracing engagement about the bottle neck 11 and restraint by the bead 13. More particularly, the C-shaped clip 16 is of a substantially constant cross-sectional configuration, see FIGS. 2 and 4, being internally concave, as at 17, for conforming engagement about and reception of the rib or bead 13. Thus, the clip 16 by its inherent stiff resilience firmly embraces the bottle neck 11, and by its specific internal configuration conformly engages and receives the bead 13, so as to securely fasten itself about the bottle neck 11, while permitting of deliberate removal and replacement, as required.

A substantially maximum holding action is obtained from the clip 16 by its almost complete circumposition about the bottle neck 11 and bead 13, the clip ends 18 being proximate to each other and spreadable to facilitate removal and replacement of the clip with respect to the bottle neck.

Medially between the clip ends 18, extending upwardly from the upper edge 19 of the clip 16, integral therewith, is a generally flat strip or strap 20. Thus, the strap 20 upstands from a medial region of the clip 16 generally opposite to the clip ends 18, the strap being relatively flexible and having its lower end efficiently anchored to the bottle neck 11 by the clip 16.

A cap is generally designated 25, and formed integrally with the upper end of strap 20 for removing closing engagement over the open end or mouth 12 of the bottle neck 11.

More specifically, the cap 25 includes a generally annular, cylindrical or circumferential side wall 26 having its lower edge 27 integral with the upper end of strap 20. Thus, strap 20 has its lower end generally coplanar and integral with clip 16, and has its upper end generally coplanar and integral with cap circumferential wall 26.

Extending across the upper end or top of the generally cylindrical circumferential or side wall 26 is a generally flat top wall 28. That is, the top wall 28 extends entirely across the circumferential or side wall 26, and is provided at one region generally opposite the strap 20 with a generally coplanar extension or tab 29, as a finger pull, which will appear more fully hereinafter. In addition, along one side edge the top wall 28 is provided with an additional extension or projection, as at 30 in FIG. 1, which may be generally coplanar with the top wall, also providing a finger press, as will appear more fully hereinafter. In the closed condition, the cap top wall 28 seats in closing relation on and extends across the bottle mouth 12.

Interiorly of the cap circumferential or side wall 26, along the lower edge 27 of the side wall, there may be provided interiorly thereof a flange, lip or shoulder 31 which may be configured to taper inwardly to a relatively sharp inner edge, see FIGS. 2 and 4. The internal circumferential flange or lip 31, by its dimensions and the characteristics of the material, is relatively flexible for conforming engagement with the bottle neck so as to effectively close and seal the bottle, notwithstanding the presence of screw threads, and the like.

In use, the arrangement of strap 20 generally flush or copplanar with clip 16 and wall 26 facilitates closure by enabling a user to initiate closure by merely placing a finger on the strap to start the cap 25 toward its closed position on the bottle neck. The side lip or finger extension 30 has been found to greatly facilitate operation, enabling many persons to open and close the device with a single hand, mere thumb pressure downwardly on the lip 30 while grasping the bottle neck serving to close the closure 15, and thumb pressure upwardly beneath the lip 30 while grasping the bottle neck serving to open the closure. Of course, the device of the present invention may be oriented as desired, relative to the bottle 10, being rotatable by merely rotating the clip 16 on the bead 13, as in relation to a bottle handle, or for other reason.

Althrough the present invention has been described in some detail by way of illustration and example for purposes of clarity of understanding, it is understood that certain changes and modifications may be made within the spirit of the invention.

What is claimed is:

1. A bottle closure integrally fabricated of resiliently flexible plastic and a bottle having a neck, a mouth at one end of the neck and a bead on the neck spaced from the mouth, said closure comprising: a generally C-shaped resilient clip removably embraceable about the neck in conforming engagement with the bead for retention by the latter spaced from the mouth, a strap upstanding from a medial region of said clip closely adjacent the neck toward said mouth, and a cap extending from the upper end of said strap engageable in closing relation over and sealingly engageable about the mouth, said strap being flexible to mount said closure for swinging movement between said closing relation and an open relation spaced from said mouth with said strap extending away from said neck, so that strap displacement toward said neck moves said cap toward said closing relation.

2. A bottle closure according to claim 1, said clip being of hollow cross-sectional configuration for conforming receiving the neck bead within the clip hollow.

3. A bottle closure according to claim 1, wherein the neck bead is of constant cross-sectional configuration and extending annularly about the neck, said clip being of constant cross-sectional configuration for conforming overlying engagement with the bead in any desired angular position about the neck.

4. A bottle closure according to claim 1, said strap being substantially straight in undistended condition for extension closely along the bottle neck.

5. A bottle closure according to claim 4, said cap including a top wall engageable over the mouth opening, and a peripheral side wall extending circumferentially entirely about the mouth, said strap having its upper end connected to the lower edge of and substantially coplanar with said peripheral side wall.

6. A bottle closure according to claim 1, said cap including a top wall engageable over the mouth opening, a peripheral side wall extending circumferentially entirely about the mouth, and a resiliently flexible inwardly extending circumferential lip on the lower edge of said peripheral side wall for conforming engagement with the neck.

7. A bottle closure according to claim 6, said clip being of hollow cross-sectional configuration for receiving the neck bead within the clip hollow.

8. A bottle closure according to claim 7, said strap being substantially straight in undistended condition for extension closely along the bottle neck.

* * * * *